US006659515B2

(12) United States Patent
Raymond et al.

(10) Patent No.: US 6,659,515 B2
(45) Date of Patent: Dec. 9, 2003

(54) POWER-CLOSING MOTOR-VEHICLE DOOR LATCH

(75) Inventors: Raja Raymond, Clarkstone, MI (US); Aleksandar Hrnjak, Windsor (CA); Marek Czekanski, Ann Arbor, MI (US)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 10/282,920

(22) Filed: Oct. 29, 2002

(65) Prior Publication Data

US 2003/0080569 A1 May 1, 2003

Related U.S. Application Data

(60) Provisional application No. 60/338,995, filed on Oct. 30, 2001.

(51) Int. Cl.[7] ..... E05C 3/06
(52) U.S. Cl. ..... 292/201; 49/280
(58) Field of Search ..... 292/216, 201, 292/DIG. 23, DIG. 43; 49/179, 280

(56) References Cited

U.S. PATENT DOCUMENTS 4,762,348 A * 8/1988 Matsumoto ..... 292/201
5,216,838 A * 6/1993 DeLand ..... 49/280
5,640,807 A * 6/1997 Shigematsu ..... 49/449
5,938,252 A * 8/1999 Uemura ..... 292/201
6,409,233 B1 * 6/2002 Hanaki ..... 292/144
6,575,517 B2 * 6/2003 Yamagishi ..... 296/76

* cited by examiner

*Primary Examiner*—Gary Estremsky
(74) *Attorney, Agent, or Firm*—Herbert Dubno; Andrew Wilford

(57) ABSTRACT

A motor-vehicle door latch has a pair of engageable parts one of which is movable between a pair of end positions and through an intermediate position and a pair of end-position sensors and an intermediate position sensor operable when the parts reach the respective positions. A drive engages at least one of the parts for displacing the parts from one end position through the intermediate position into the other end position. A controller operates the drive to displace the parts from the one end position to the intermediate position only when travel of the parts from the one end position to the intermediate position takes place in less than a predetermined first time and displaces the parts from the intermediate position to the other end position only when travel of the parts from the intermediate position to the other end position takes place in less than a predetermined second time different from the first time.

5 Claims, 6 Drawing Sheets

POWER-CLOSING MOTOR-VEHICLE DOOR LATCH

CROSS REFERENCE TO RELATED APPLICATION

This application is a related to provisional application No. 60/338,995 filed Oct. 30, 2001.

FIELD OF THE INVENTION

The present invention relates to a motor-vehicle door latch. More particularly this invention concerns such a latch provided with a power closer.

BACKGROUND OF THE INVENTION

A motor-vehicle door latch, for instance used on a side door of the pivoting or sliding type, on a sliding sun roof, or even on a pivoting trunk lid is often provided with a power closer that itself effects the final closing movement of the door. Thus the user typically pushes the door into an intermediate position in which the door is slightly ajar and in which elements of the latch and the door interengage, and thereafter the power closer pulls the door into an end position flush with the vehicle. The door latch typically comprises a pivotal fork mounted on the door post or door edge, and a bolt fittable in the fork and mounted on the door edge or post. The power closer can be connected to the fork or to the bolt so as to effect the movement from the intermediate partially closed position to the end fully closed position.

In order to prevent the door from closing on a finger and to avoid damage to the door and/or the power closer, it is standard to provide a system that will stop the power closing when certain conditions are present. In the simplest system the force, typically a torque, exerted by the actuator, normally a rotary electric motor, is monitored and when it exceeds a predetermined limit the power closing is stopped and, often, the door movement is even reversed. Such crude systems are only barely effective and often can exert enough force to, for instance, pinch a person badly enough to cause a serious injury. If they are set to be too sensitive, the door does not close just when a sticky part of the track or something is encountered.

Accordingly U.S. Pat. No. 4,585,981 proposes a system that uses a potentiometer as described in U.S. Pat. No. 4,556,835 to detect the actual position of the door. This actual-position signal is monitored with respect to time to produce a speed signal that in turn is differentiated to produce an output corresponding to acceleration or deceleration. When the door decelerates too much, indicating something is in its path, the closing movement is stopped and even reversed. Such an arrangement has the disadvantage that a standard door, for instance a sun roof, is likely to move at substantially different speeds as it travels from a fully open to a fully closed position even when operating perfectly with nothing in the way. Thus the threshold has to be set fairly high to correspond, for instance, to the rapid deceleration as the door comes into contact with a seal. Thus if something can be pinched rather forcefully in the door before it stops and reverses.

In U.S. Pat. No. 6,176,528 another arrangement is described which ascertains several exact positions of the door. This system is used typically with a trunk lid to prevent it from automatically closing again if its latch is released when there is some weight, for instance ice, on it preventing it from popping open. Thus the system does not allow the power-closing action to take place until the door has moved outward past a predetermined intermediate position. As a result if some weight holds the door down when its latch is released, the user can still force it open and subsequently close it with the standard power-closing feature.

Another system described in European 0,979,915 proposes a latch for a motor-vehicle door. On actuation of an unlocking mechanism there is simultaneously a mechanical interruption of the force applied between the drive of the power closer and the closing door. Another latch described in German 199 28 509 is provided with a system for monitoring the instantaneous position of the door, much as in above-cited U.S. Pat. No. 4,556,835. This system serves for trunk lids or doors of a motor vehicle with a closing element and two read/writable memories in which are stored desired positions the door should reach. The system compares the actual position of the door with the desired position to control opening and/or closing of the door. Such a system is relatively complex and does not, once again, take into account the different resistances to movement and speed profile of the door as it moves between open and closed end positions.

OBJECTS OF THE INVENTION

It is therefore an object of the present invention to provide an improved power-closing door latch for a motor vehicle.

Another object is the provision of such an improved power-closing door latch for a motor vehicle which overcomes the above-given disadvantages, that is which prevents the power closer from operating in a manner tailored to the particular characteristics of movement of the door.

SUMMARY OF THE INVENTION

A motor-vehicle door latch has according to the invention a pair of engageable parts one of which is movable between a pair of end positions and through an intermediate position between the end positions and a pair of end-position sensors and an intermediate position sensor operable when the parts reach the respective positions for generating respective outputs. A drive engages at least one of the parts for displacing the parts from one end position through the intermediate position into the other end position. A controller connected to the drive and to the sensors operates the drive to displace the parts from the one end position to the intermediate position only when travel of the parts from the one end position to the intermediate position takes place in less than a predetermined first time and displaces the parts from the intermediate position to the other end position only when travel of the parts from the intermediate position to the other end position takes place in less than a predetermined second time different from the first time.

Thus with this system it is possible to set different response characteristics for the latch for different parts of its closing movement. It can be made relatively sensitive to blockages during the initial stages of its closing, but less sensitive in the later stages when it must compress the door seal, for instance.

The controller according to the invention reverses the drive when travel of the parts from the one end position to the intermediate position exceeds the first time and when travel of the parts from the intermediate position to the other end position exceeds the second time. Thus if something blocks the door, it will open again.

The one end position corresponds to a partially latched position of the latch in accordance with the invention. The intermediate position corresponds to a latched position of the latch. The other end position corresponds to an overtravel position of the latch, past the latched position.

The one part is a pivotal fork and the other part is a bolt engageable therewith. The drive includes a motor having a rotary output, a wheel carried on the output, a link connected between the wheel and the fork for pivoting of the fork on rotation of the wheel. The fork is pivotal about an axis and two of the sensors are axially spaced from one another but angularly aligned. The fork having a pair of axially spaced arms of angularly different lengths engageable with the two sensors.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
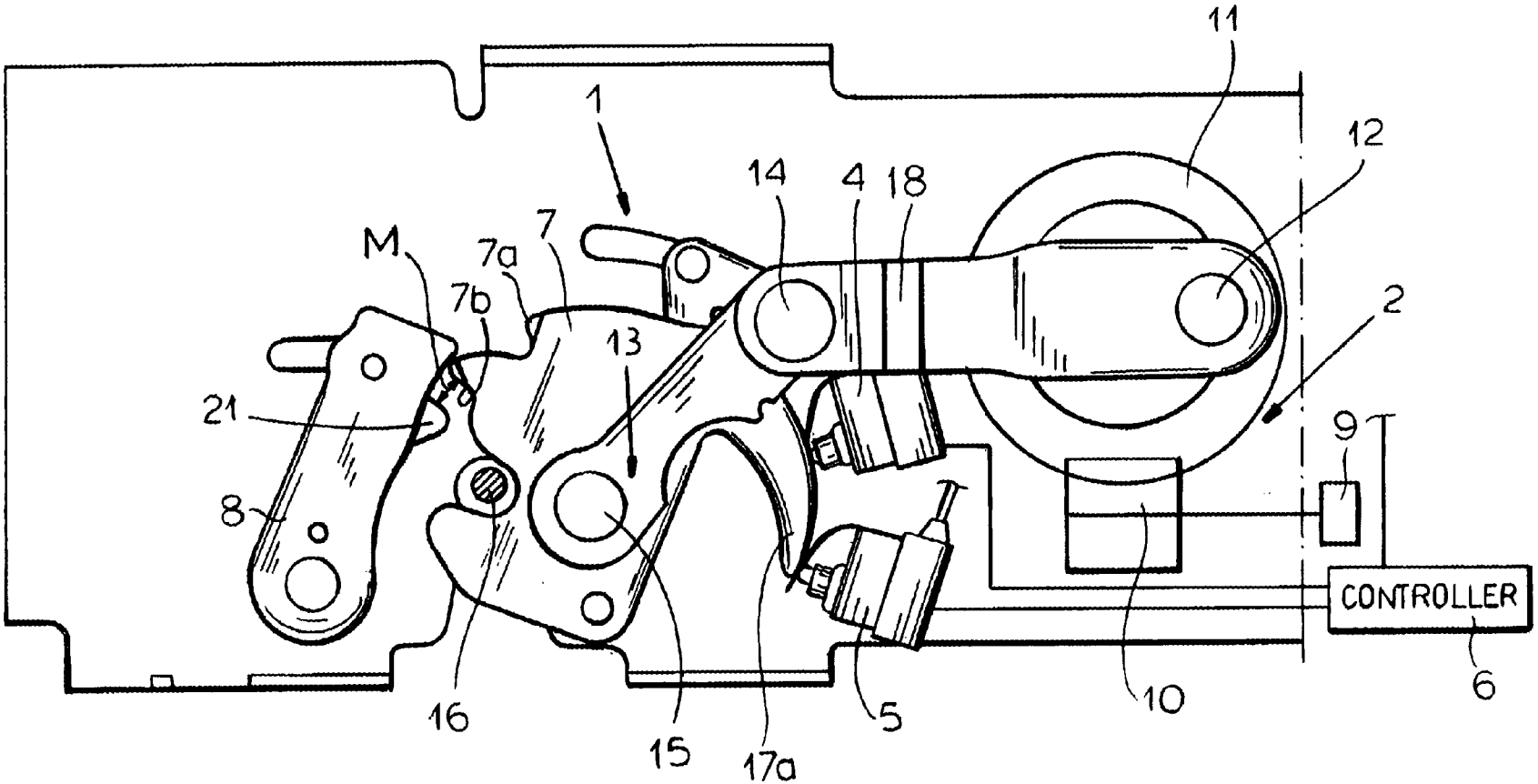
FIG. 3 is a partly diagrammatic side view of the latch in an overtravel or end position.
Figure 4:
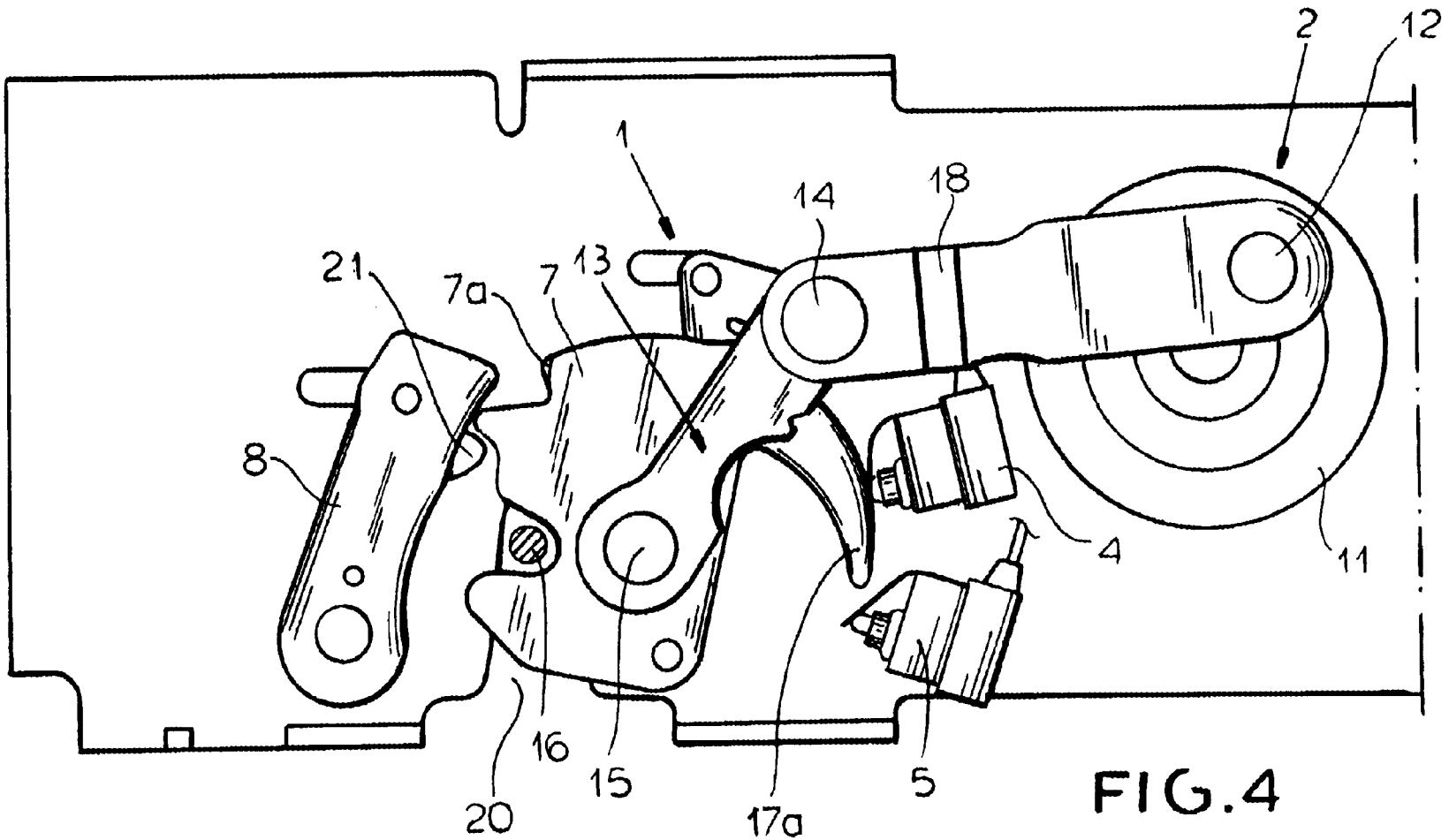
FIG. 4 is a view like FIG. 1 of the door in a latched position.

As seen in FIGS. 1 through 4 a door latch has a housing 19 that can be mounted on a motor-vehicle body and that coacts with a bolt 16 mounted on the door, although the bolt 16 can be on the vehicle body and the housing 19 on the door if desired. The latch has a power closer 1 having a drive 2 and three position-detecting sensors or switches 3, 4, and 5 respectively operated in a starting prelatched position (FIG. 1), an intermediate position (FIG. 2), and an overtravel or end position (FIG. 3). The position of FIG. 4 is near that of FIG. 2 and between that of FIGS. 2 and 3.

The bolt 16 can move into an out of a mouth 20 of the housing 19 and into and out of engagement with a pivotal fork 7 having an axle 15 from which extends an arm 13 that is fixed to the fork 7 to pivot jointly therewith. A pawl 8 operated by a handle or release mechanism 22 can retain the fork 7 in the partially latched starting position of FIG. 1 and the fully latched position of FIG. 4 by engaging with a tooth 21 against respective steps 7*a* and 7*b* of the fork 7.

The drive 2 comprises a wheel 11 operated by a worm 10 (FIG. 3) from a reversible electric motor 9 in turn operated by a controller 6 also connected to the sensor switches 3, 4, and 5. A link 18 has one end pivoted on an offcenter crank pin 12 of the wheel 11 and an opposite end on a pivot 14 at the outer end of the arm 13. The radius from the pin 12 to the center of the wheel 11 is much smaller than the radius from the pivot pin 14 to the center of the axle 15 so that 180° revolution of the wheel 11 moves the fork 7 through substantially less than 90°. Thus rotation of the wheel 11 pivots the fork 7 between the illustrated positions with a substantial mechanical advantage.

A pair of arcuate arms 17*a* and 17*b* fixed on the fork 7 and arm 13 lie in separate parallel planes perpendicular to the axle 15 and are of different angular lengths. The two switches 3 and 5 are in the path of the long arm 17*a* and the switch 4 in that of the short arm 17*b*. The switches 3 and 4 are in the same angular position relative to the axle 15 but the lengths of the arms 17*a* and 17*b* are such that as the fork 7 is rotated clockwise as shown in the drawing, first the long arm 17*a* will operate the switch 3 (FIG. 1), then the short arm 17*b* will operate the switch 4 (FIG. 2), and finally the long arm 17*a* will operate the switch 5 (FIG. 3). Once actuated, the switches 3, 4, and 5 remain actuated until the fork 7 pivots back counterclockwise and releases them, so that the controller 6 will have information to allow it to determine not only what position the fork 7 is in, but which direction it is moving in.

Figure 1:
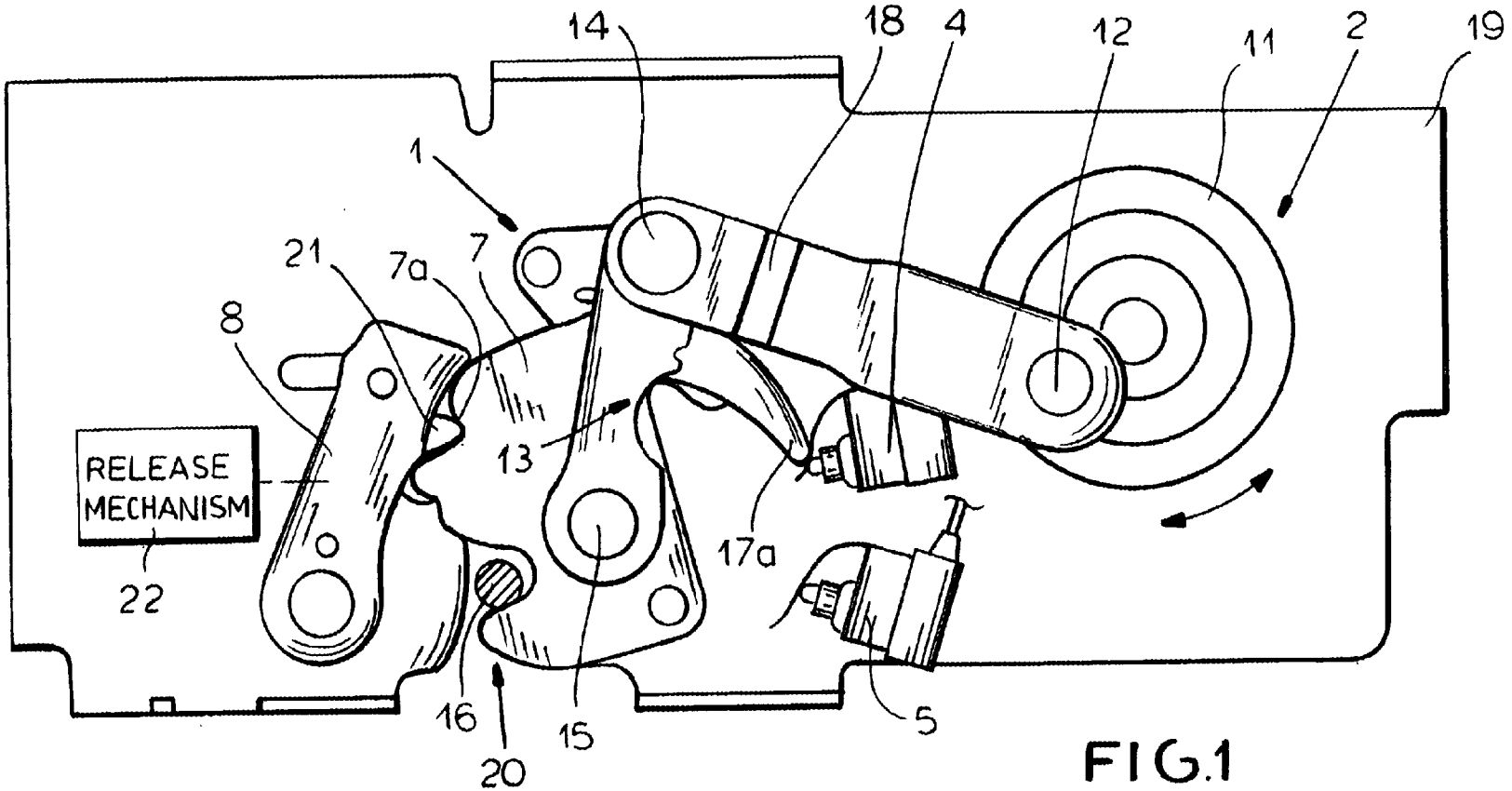
FIG. 1 is a side view of a door latch according to the invention in a starting prelatched position.
Figure 2:
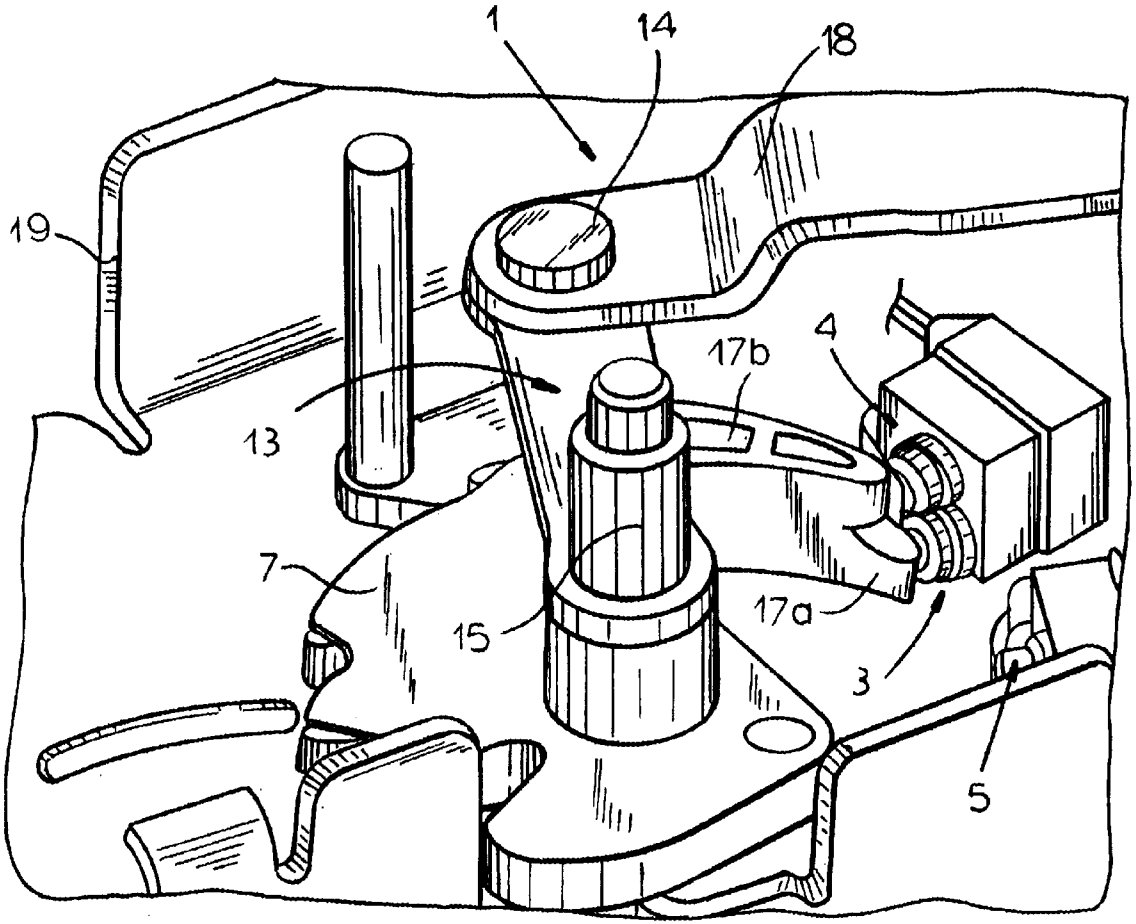
FIG. 2 is a perspective view of a detail of the latch in an intermediate position.
Figure 5:
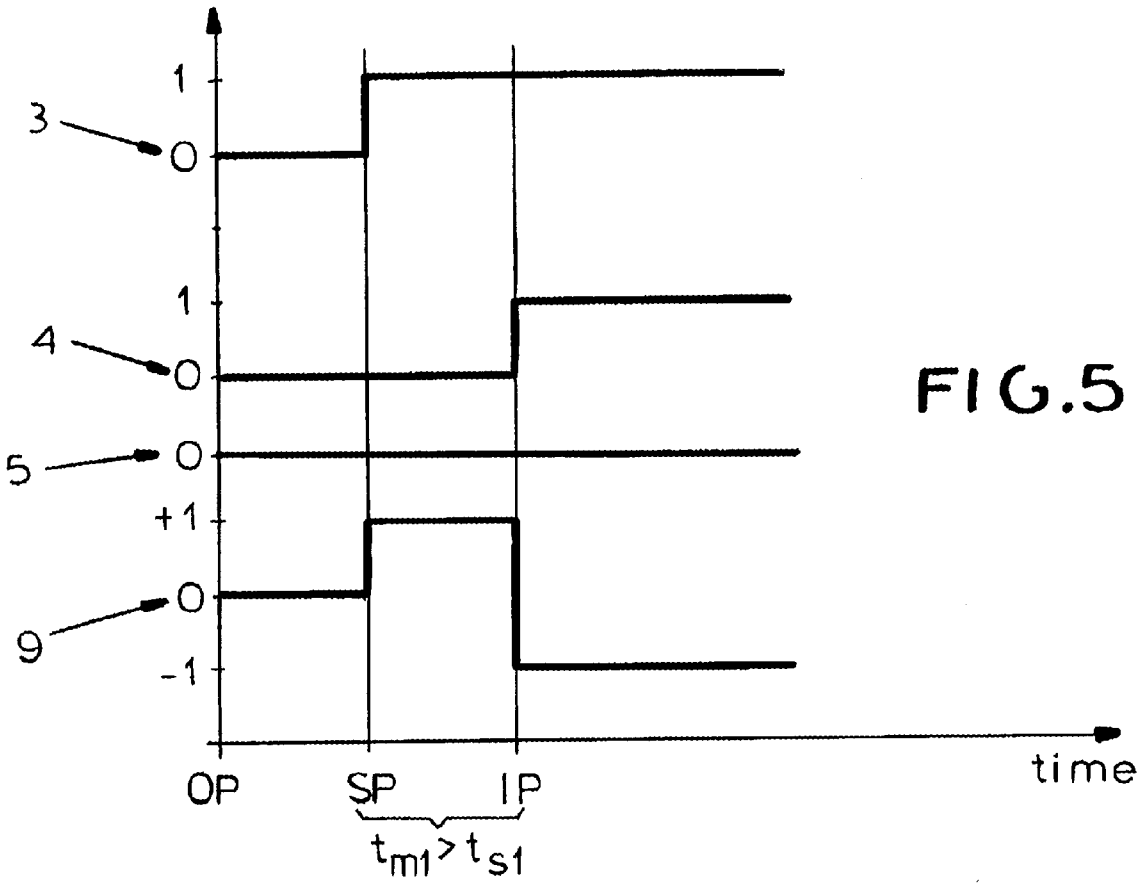
FIGS. 5 and 6 are diagrams illustrating operation of the door closer respectively when the door is blocked and clear.
Figure 6:
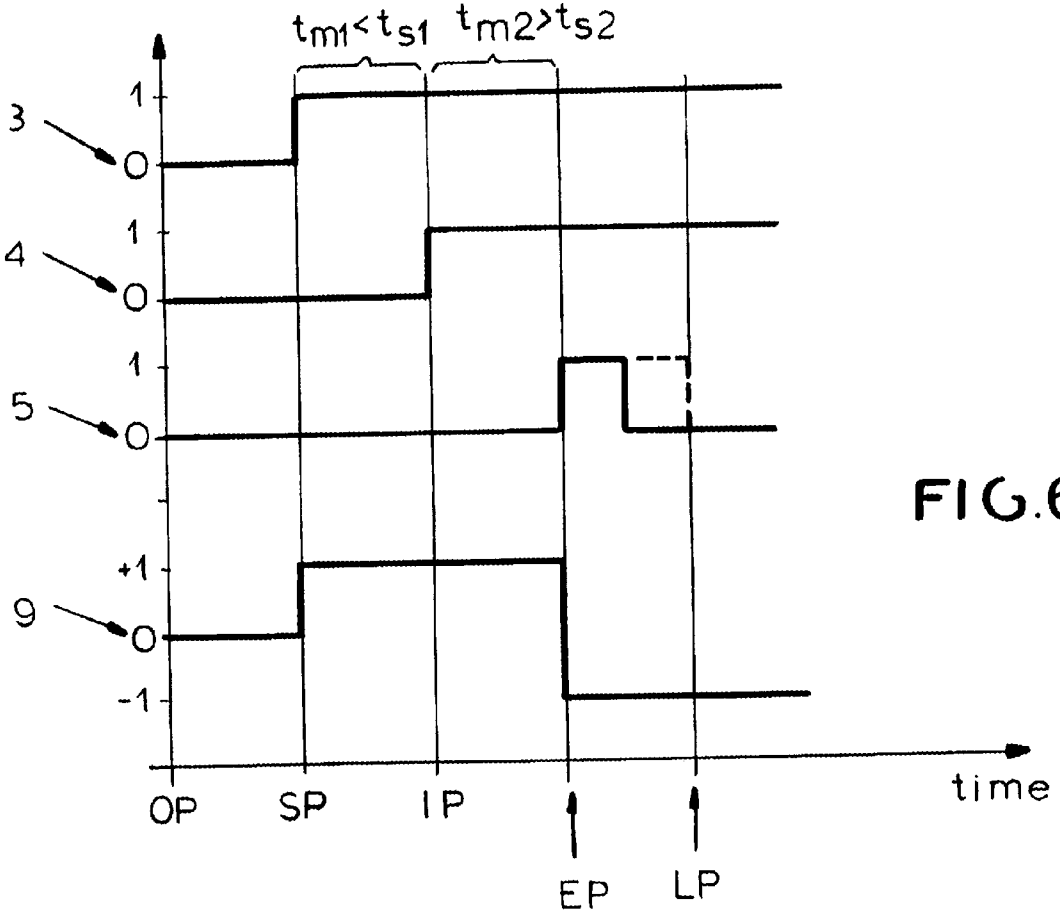

FIGS. 5 and 6 illustrate the operation of the system of this invention with the actuated positions of the switches shown as "1" and the unactuated positions as "0". For the motor 9, "+1" corresponds to clockwise pivoting of the wheel 11 and fork 7, "−1" to reverse pivoting, and "0" to no movement. Time is plotted on the abscissa and the starting position of FIG. 1 is shown at SP, the intermediate position of FIG. 2 at IP, the end overtravel position of FIG. 3 at EP, and the latched position of FIG. 4 (which for the fork 7 actually is between the end position EP and the intermediate position IP) at LP. The ordinate represents an unillustrated open position OP of the latch with the fork 7 pivoted out such that the bolt 16 can freely enter and leave the mouth 20 of the housing 19.

The system operates as follows:

When as shown in FIG. 5 the housing 19 and bolt 16 are pushed together into the starting position SP, the bolt 16 engages in the fork 7 and pivots it into the starting position SP in which the tooth 21 of the pawl 8 engages the first step 7*a* of the fork 7 as shown in FIG. 1. This operates the switch 3. The controller 6 then energizes the motor 9 to rotate the fork 7 clockwise. If the time $t_{m1}$ it takes the wheel 11 to move through about 45° to move the fork 7 from the starting position SP to the intermediate position IP is greater than a predetermined time ts1, the controller 6 will stop the motor 9 and open the latch via the release mechanism 22. This can happen when something is stuck between the door and vehicle body, holding open the door and making the time $t_{m1}$ greater than ts1.

On the contrary, as shown in FIG. 6 if the time $t_{m1}$ it takes the fork 7 to move from the starting position SP to the intermediate position IP is equal to or less than the set-point time $t_{s1}$ the motor 9 continues to run until the end position EP is reached. At this point as shown in FIG. 3 the step 7*b* is spaced by a short distance M past the tooth 21 and the switch 5 is actuated. This actually represents a short overtravel of the fork 7 and ensures that the tooth 21 will engage behind the step 7*b* and that the door associated with the latch is tightly closed. Actuation of the switch 5 in this end position EP causes the controller 6 to reverse the motor 9 briefly until the switch 5 is again opened and the latch has returned to the latched position LP of FIG. 4.

The same relationship holds for travel between the intermediate position IP and the end position EP. Thus, if the time $t_{m2}$ it takes the fork 7 to move through this distance is greater than a predetermined time $t_{s2}$, the controller 6 will stop the motor 9 and open the latch via the release mechanism 22. The two set-point time intervals $t_{m1}$ and $t_{m2}$ are different according to the invention. This makes it possible for the system, for instance, to respond more sensitively in the initial closing stages when a finger or something is most likely to be pinched between the door and the vehicle body. In the latter stages the door, especially if it a slider, is presumably clear and needs to be pulled to with considerable force to ensure complete latching and good sealing.

If any of the switches fails, as a backup, when the stall current of the motor reaches 10 amp, the controller 6 will stop the motor 9 and open the latch via the release mechanism 22.

We claim:

1. A motor-vehicle door latch comprising:

a pair of engageable parts one of which is movable between a pair of end positions and through an intermediate position between the end positions;

a pair of end-position sensors and an intermediate position sensor operable when the parts reach the respective positions for generating respective outputs;

drive means engaging at least one of the parts for displacing the parts from one end position through the intermediate position into the other end position; and control means connected to the drive means and to the sensors for operating the drive means to displace the parts from the one end position to the intermediate position only when travel of the parts from the one end position to the intermediate position takes place in less than a predetermined first time and displace the parts from the intermediate position to the other end position only when travel of the parts from the intermediate position to the other end position takes place in less than a predetermined second time different from the first time.

2. The motor-vehicle door latch defined in claim 1 wherein the control means reverses the drive means when travel of the parts from the one end position to the intermediate position exceeds the first time and when travel of the parts from the intermediate position to the other end position exceeds the second time.

3. The motor-vehicle door latch defined in claim 1 wherein the one end position corresponds to a partially latched position of the latch, the intermediate position corresponds to a latched position of the latch, and the other end position corresponds to an overtravel position of the latch.

4. The motor-vehicle door latch defined in claim 1 wherein the one part is a pivotal fork, the other part is a bolt engageable therewith, and the drive means includes:

a motor having a rotary output;

a wheel carried on the output;

a link connected between the wheel and the one part for pivoting of the one part on rotation of the wheel.

5. The motor-vehicle door latch defined in claim 4 wherein the fork is pivotal about an axis and two of the sensors are axially spaced from one another but angularly aligned, the fork having a pair of axially spaced arms of angularly different lengths engageable with the two sensors.

* * * * *